United States Patent [19]

Chaplin et al.

[11] 4,122,303

[45] Oct. 24, 1978

[54] IMPROVEMENTS IN AND RELATING TO ACTIVE SOUND ATTENUATION

[75] Inventors: George Brian Barrie Chaplin; Roderick Alan Smith, both of Colchester, England

[73] Assignee: Sound Attenuators Limited, Colchester, England

[21] Appl. No.: 749,472

[22] Filed: Dec. 10, 1976

[51] Int. Cl.[2] ..... H04R 1/28

[52] U.S. Cl. ..... 179/1 P; 179/1 F

[58] Field of Search ..... 179/1 P, 1 F

[56] References Cited

U.S. PATENT DOCUMENTS

| | | | |
|---|---|---|---|
| 2,776,020 | 1/1957 | Conover | 179/1 P |
| 2,983,790 | 5/1961 | Olson | 179/1 P |
| 3,784,747 | 1/1974 | Berkley | 179/1 P |
| 3,936,606 | 2/1976 | Wanke | 179/1 P |

*Primary Examiner*—Thomas W. Brown
*Assistant Examiner*—E. S. Kemeny
*Attorney, Agent, or Firm*—Howson and Howson

[57] ABSTRACT

A primary sound wave in a confined space is attenuated by a secondary sound wave generated to null with the primary wave. The secondary wave is produced by a first electrical signal representing the primary wave as sensed by a microphone, which is convolved with a second signal derived from the system impulse response as a program of operational steps. A second convolution process can cancel feedback of the secondary sound wave. Downstream residual noise is sensed by a second microphone which feeds a microprocessor which adjusts the convolution processes.

10 Claims, 15 Drawing Figures

Figure 1:
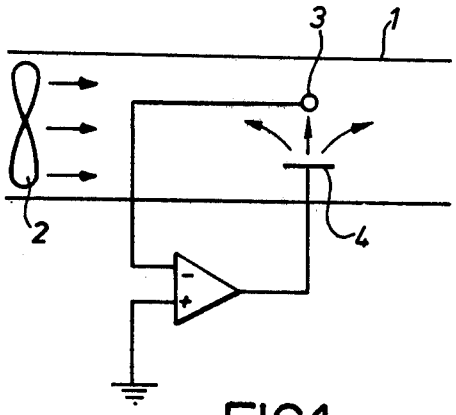

FIG.8b.
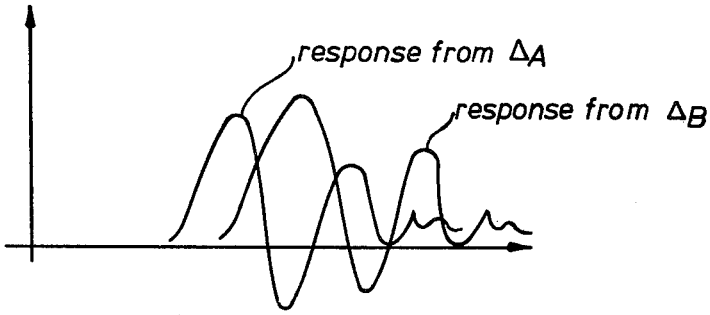
FIG.8c.
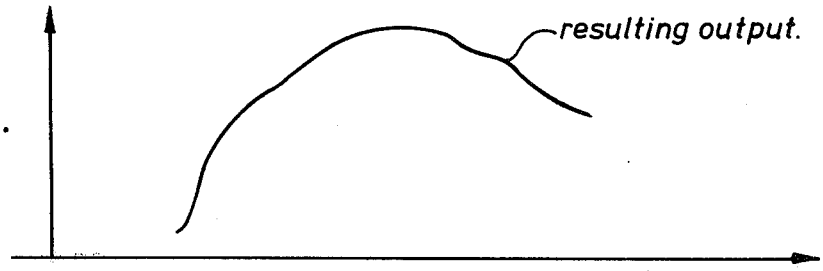
FIG.9.
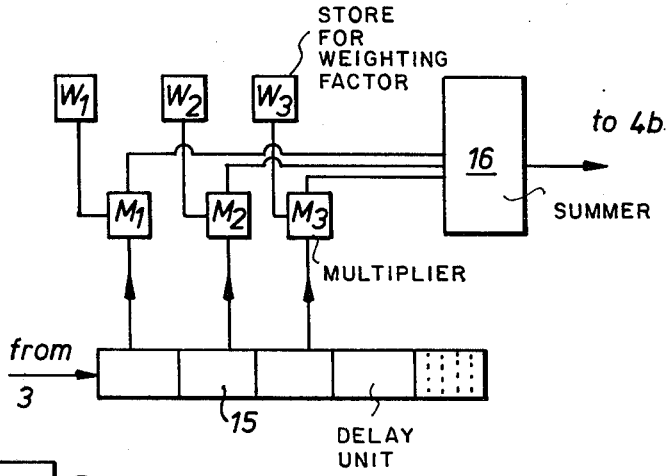
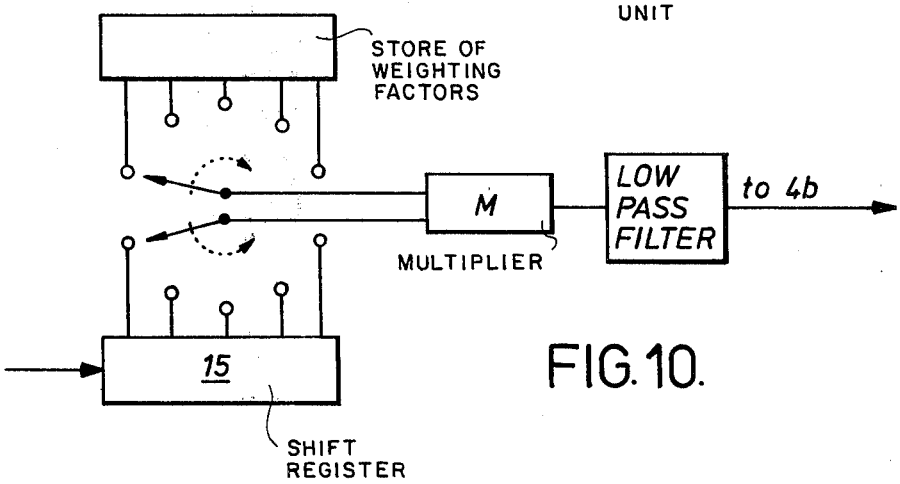
FIG.10.

IMPROVEMENTS IN AND RELATING TO ACTIVE SOUND ATTENUATION

This invention relates to a method of and apparatus for the "active" attenuation of longitudinal compression waves and has particular application to the attenuation of airborne sound (e.g. in a duct or other confined space).

It has long been appreciated that since a sound wave consists of a sequence of compressions and rarefactions the energy content of the wave can be reduced by combining the primary wave with a specially generated secondary wave in such wise that the rarefactions of the secondary wave coincide with the compressions of the primary wave and vice versa. This principle (known as "active" attenuation) acts to reduce the pressure changes existing in the medium and thus extracts energy from the primary wave. In broad outline this "active" method of sound attentuation is described in U.S. Pat. No. 2,043,416 and much work has been done in this field in recent years.

The secondary wave has to be generated strictly with regard to the primary wave it is to "null" and although considerable success has been achieved in the "active" sound attenuation of primary waves of simple sinusoidal form, the quality of attenuation so far achieved where the primary wave is a naturally occurring "noise" (i.e. the primary wave varies in both amplitude and frequency in a random time-dependent manner) has been far less satisfactory.

This invention relates to a method of and apparatus for generating a secondary wave for "active" attenuation of any given primary wave which offers a high degree of attenuation irrespective of the complexity of the primary wave and in preferred embodiments incorporates a self-correcting facility, the response of the system being modified on the basis of its previous performance.

According to a first aspect of the present invention apparatus for achieving attenuation of a primary wave in a system by a specially generated secondary wave comprises first transducer means for deriving a first electrical signal representing, in a time-related manner, the primary wave to be attenuated, second transducer means for generating the secondary wave from a second electrical signal, storage means in which a programme of time-related operational steps is contained and means for convolving the first electrical signal with the programme to produce the second electrical signal.

In one arrangement of the apparatus in accordance with the invention the programme characterises the time response of the system to a specified change at the input of the first transducer and the steps of the programme may be derived by determining the impulse responses of the system to a variety of different delta functions applied as inputs to the first transducer.

In a modified apparatus in accordance with the invention a nulling transducer can be located downstream (in the sense of the direction of propagation of the primary wave) of the first and second transducers, the output of the nulling transducer being employed to modify the second electrical signal. This modification of the second electrical signal can be effected by adjusting the programme of operational steps involved in the convolving and/or the amplitude of the second electrical signal.

The storage means may be of analogue, digital or of combined analogue/digital form and conveniently the first electrical signal is also stored, the convolving being effected by means of at least one multiplier operating between the storage means for the first signal and the storage means for the characterisation of the system. Where a plurality of multipiers are available it is suitable to have one for each operational step stored but a single multiplier which is time multiplexed may be employed.

According to a further aspect of the present invention a method of attenuating sound in a defined space comprises deriving a first electrical signal representing, in a time-related manner, a primary sound wave which is to be attenuated and which is entering said space, and using said first electrical signal to derive a second electrical signal, said second electrical signal being used in a second transducer to generate a secondary wave in said space which will at least partially nullify the primary wave in said space, and is characterized in that the second electrical signal is derived from the first by convolving the first electrical signal with a programme of time-related operational steps.

The programme of time-related operational steps may be preset and remain unchanged. The determination of the pre-set steps may be based on the response of the system (i.e. the two transducers, the coupling electrical components and the defined space) to characterising impulses.

Alternatively an adaptive strategy such as that of successive approximation may be employed using a further transducer in the defined space to determine the success of the nullifying operation. The changes in the programme of operational steps may be effected manually in response to the output of a transducer in the defined space but full- or semi-automatic correction can be employed.

Where the method of the invention is employed for the attenuation of gasborne sound waves travelling in a duct, the first electrical signal can be derived from the output of a microphone located in the duct upstream of a loudspeaker from which the secondary wave comes. With this arrangement some energy generated by the loudspeaker can "feedback" through the duct to the microphone giving a false representation of the primary wave which requires to be attenuated. The elimination of this "feedback" signal has presented problems and its elimination has been proposed by a number of methods which include lining the duct with sound attenuating material in the region between the loudspeaker and the microphone and using a highly directional microphone which is sensibly "deaf" to the feedback signal.

In accordance with a further aspect of this invention, the feedback signal picked up by the microphone can be compensated for by subtracting an appropriate electrical signal from the microphone which has been derived by a second convolution simulating the path between the input terminals of the loudspeaker, the ducting between the loudspeaker and the microphone and the output terminals of the microphone.

If the first convolution system is optimised by the earlier mentioned adaptive process, the first convolution will to a certain extent, be removing unwanted effects from the feedback path just described. Thus a reasonable degree of cancellation can be achieved by the first convolution especially in conjunction with the aforementioned passive attenuation and/or directional microphone.

Figure 5:
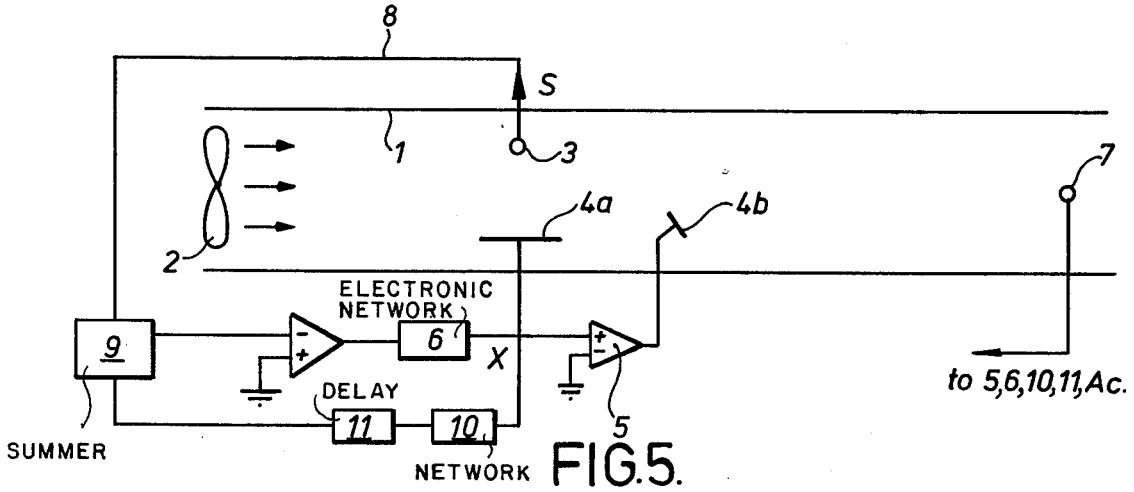
Figure 6:
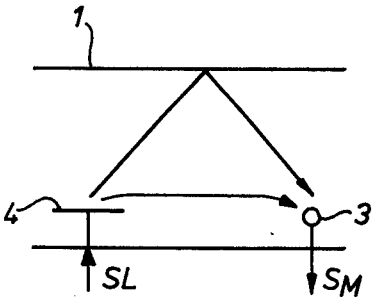
Figure 7:
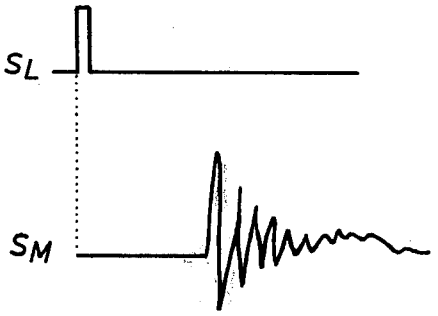

The invention will now be further described, by way of example, with reference to the accompanying drawings, in which:

FIGS. 1–6 are schematic representations of the equipment used for active sound attenuation, FIGS. 7–8*c* indicate one way of obtaining a characterisation of a system for use in the method and apparatus of the invention, and FIGS. 9 to 13 indicate systems for use in the method of the invention.

The basic principles of active sound attenuation are illustrated by FIGS. 1 to 6.

Consider first FIG. 1, this shows a duct 1 (of any cross-section) with a fan 2 located at some point along its length. Sound (the primary wave) from the fan 2 propagates down the duct 1 and attempts to actuate a microphone 3. A loudspeaker 4 reacts in such a way as to try to prevent the microphone from being actuated, and in so doing emits an anti-phase sound waveform.

The paths of this waveform will depend on the directional properties of the loudspeaker system, the nature of the duct 1, and the frequencies of the sound. Of main interest is the sound propagating to the right (the secondary wave) in the same direction as tht from the fan because it is in antiphase and proceeding in the same direction. If its magnitude is correct, and a plane wavefront is quickly established, then cancellation of the primary wave from the fan 2 will occur.

FIG. 1 shows an arrangement in which the microphone and loudspeaker are very close and substantially equidistant from the source 2. The principle however applies to arrangements in which the transducers are spaced apart in the direction of sound propagation as shown in FIGS. 2–6.

The magnitude of sound emitted by the loudspeaker 4 in FIG. 1 can be varied by varying the acoustic attenuation in the sound path between the speaker 4 and the microphone 3, an increase in attenuation increasing the level of sound emitted by the loudspeaker 4. Alternatively, the magnitude of sound can be controlled electronically, and FIG. 2 shows one such method.

Figure 2:
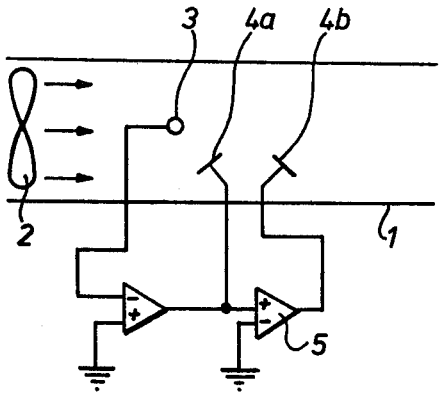

In the arrangement of FIG. 2, two loudspeakers 4*a* and 4*b* are illustrated these being arranged in such a way that the output from 4*b* can be controlled by the gain of an amplifier 5. Adjustment of the gain thus allows adjustment of the degree of cancellation downstream. Different numbers of loudspeakers and a wide variety of different geometrical arrangements can be used for active sound attenuation, including loudspeakers mounted on other walls of the duct, in branch ducts, or within the cross section of the duct.

Figure 4:
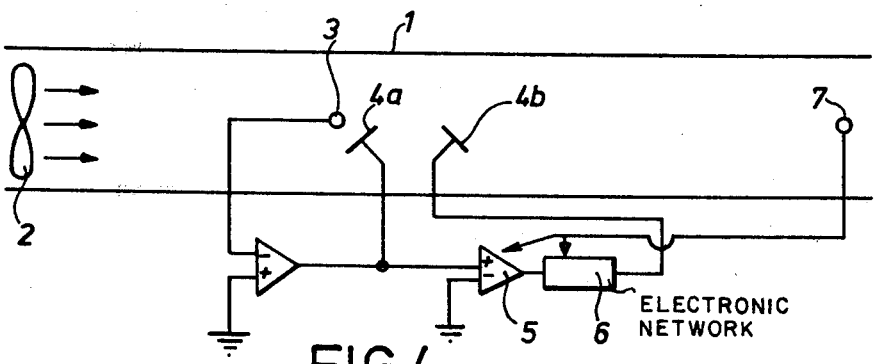

The degree of cancellation at a point downstream of the loudspeaker(s) may also be influenced by the acoustic characteristics of the duct, but this can be taken into account by including electronic networks 6 in the system to compensate for the duct characteristics as shown in FIGS. 4 and 5.

A second microphone, 7, is shown downstream in FIGS. 4 and 5. Any signal from 7 indicates lack of complete cancellation at that point and can be used to adjust, either manually or automatically, the gain of the amplifier 5 and the compensating network 6.

The amplifiers themselves can contain networks to prevent oscillation caused by delay in the feedback path. Louspeaker 4*b* can be positioned so as to deflect reflected waves away from the microphone 3 and/or the duct can be lined with sound absorbent material.

Additionally, or alternatively, a similar active system can be mounted on the opposite wall, or indeed a plurality of systems can be mounted in various positions on the various walls of the duct, or at places within the cross-section of the duct. There could also be a plurality of nulling microphones 7, in a variety of positions downstream.

If the delay of the acoustic path in the feedback loop between the loudspeaker(s) and the microphone is such that it is not short compared with the period of the highest frequency waveform of interest, then the system can be modified as, for example, in FIG. 5.

Referring to FIG. 5, the acoustic feedback path is between 4*a* and 3, the latter producing an electrical signal S.

Any signal appearing at point X has two feedback paths. The first is via 4*a*, 3, and the wire 8 to a summing point 9. The second is via a network 10 and a delay 11 to the summing point 9. The delay 11 and the network 10 combine together to compensate for the time delay occurring between 4*a* and 3 and the delay 11 and network 10 together simulate the characteristics of of the speaker 4*a*, the microphone 3 and the air path from 4*a* to 3. The two feedback paths sum in antiphase at 9 and if both have equal time characteristics they will cancel.

The integers 5, 6, 10 and 11 can be controlled either manually or automatically by, for example, the null microphone 7.

As has been stated the microphone 3 does not have to be directly opposite the loudspeaker 4*a*. It can be anywhere to the left of this point, and on any wall or at any position in the cross-section of the duct 1, although this would require an additional delay in the line between the points 9 and X.

The frequency and phase response of the loudspeaker(s) can be improved by utilising a separate winding on the loudspeaker and including it in the feedback loop of the speaker drive amplifier (not shown in the diagram).

A general problem which arises with any of the arrangements so far described for the active cancellation of sound or vibration is the desirability of knowing how a signal waveform is modified when traversing the path from a generator to a sensor, including the transducers themselves, and it is to the solution of this problem that the invention is primarily directed.

FIG. 6 shows the basic situation in the case of an air duct. If a signal $S_L$, is applied to the loudspeaker 4, a signal $S_m$ will be generated by the microphone 3. However, different frequency components will experience different delays and attenuation due to the responses of the transducers themselves, and also the different possible paths within the duct 1, two of which are shown arrowed in FIG. 6. The signal $S_m$ is thus unlikely to be merely a delayed and attenuated version of $S_L$, and if we wish to predict $S_m$ solely from a knowledge of $S_L$, it is necessary to "characterise" the path.

This can be achieved by applying suitable test signals at $S_L$ and noting how they are changed when they appear as $S_m$. For example, a delta function applied to $S_L$ might be modified in the way shown in FIG. 7. A delta function of different amplitude could be expected to be modified in a corresponding way producing the same shaped wave but of different amplitude.

The response of the duct 1 to any other signal (in this case the noise from the fan) can then be predicted by superposition of the impulse responses. An example of this is shown in FIGS. 8*a*–8*c*.

Figure 8A:
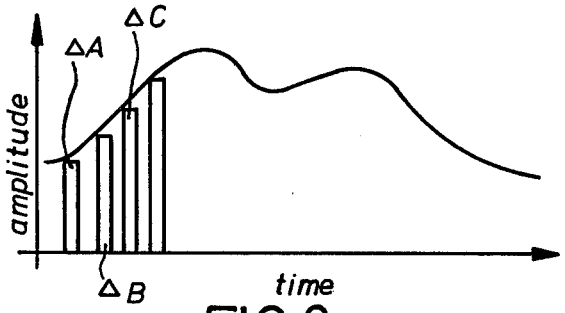

The noise from the fan can be thought of as composed of the sum of a series of delta function pulses of different amplitudes, as shown in FIG. 8*a*. Each of these pulses will give rise to a time response shown in FIG. 7 similar in shape to the test response, but with an amplitude corresponding to the instantaneous amplitude of the fan noise, as shown by the different amplitudes ΔA . . .ΔC in FIG. 8*a*. FIG. 8*b* shows the responses resulting from the two impulse responses ΔA and ΔB of FIG. 8*a*. It can be seen that the response from ΔB has a greater amplitude than that of ΔA and is also delayed by the appropriate amount. The responses can be added to predict the response of the duct to the overall waveform of the fan, FIG. 8*c*.

In accordance with a preferred aspect of the invention, the basic wave shape (or characterization) shown at ΔA in FIG. 8*b* can be stored as a series of weightings which represent the waveform amplitudes at uniformly spaced intervals along the time axis of the response shown in FIG. 7. The series of weightings constitutes a programme of time-related weightings. If this programme is convolved with a given signal $S_L$, it will indicate what the output signal $S_m$, from the microphone would be were a signal $S_L$, to have been applied to the loudspeaker 4.

Figure 3:
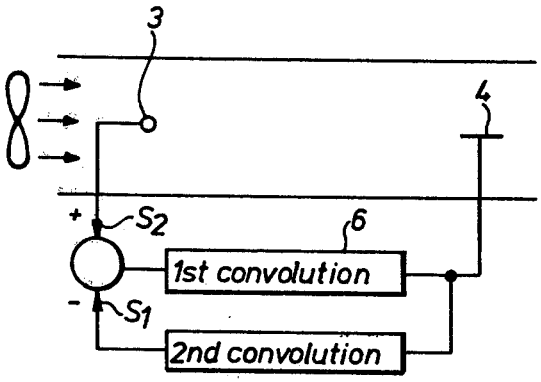

In the case of a simple arrangement (e.g. such as is shown in FIG. 3) the programme deduced by the superposition of impulse responses as described with reference to FIGS. 8*a*–8*c* will characterise the time response for upstream sound propagation which includes the speaker 4, the acoustic path between 4 and 3 and the microphone 3 (and can thus be used to compensate for feedback from 4 to 3 in the manner previously discussed).

A different "characterisation" is requird for the programme to be convolved with the output of the microphone 3 to give cancellation downstream of the loudspeaker, but this can be obtained by an adaptive process similar to that employed for the upstream "characterization". Alternatively the downstream "characterization" can be deduced empirically from the upstream "characterisation" or even calculated from the upstream "characterisation" and the characteristics of the transducers by a process of convolution division.

Complete elimination of the feedback signal can be achieved in the manner shown in FIG. 3 by electrically subtracting a signal $S_1$, derived from the cancellation loudspeaker 4 from the signal $S_2$ from the microphone 3. The derivation of the signal $S_1$ from the cancellation loudspeaker signal is performed by a second convolution as discussed above (which compensates for the response of the loudspeaker, the duct and the microphone).

Figure 11:
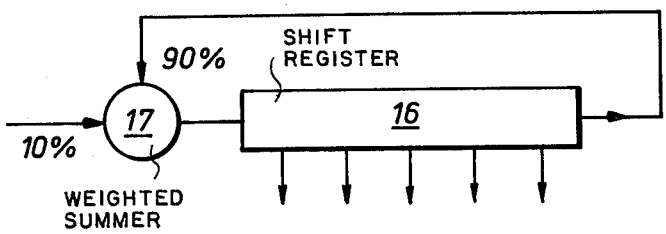

Various methods of setting up the characterisation and of performing the convolution are illustrated in FIGS. 9 to 11.

In FIG. 9, the input signal (e.g. from the microphone 3 in FIG. 3 representing the primary wave to be attenuated) is fed to a delay unit (e.g. a shift register) 15. The delay unit should store a length of input signal which is substantially equal to the duration of the stored charcterisation. In the example illustrated in FIG. 9 only three stages are shown but in practice there would be more than this (e.g. 32 stages).

A memory of weighting coefficients representing the programme of steps to be convolved with the input signal is shown as $W_1$, $W_2$, $W_3$ in FIG. 9 and as the input signal progresses through the register 15, multipliers $M_1$, $M_2$ and $M_3$ feed their output to a summer 16 which provides the basis of the signal to the loudspeaker 4*b*.

The convolving can be effected digitally or on the basis of analogues, and instead of using one multiplier for each weighting coefficient and a summer, a single multiplier M can be time multiplexed as shown in FIG. 10. The scanning rate naturally must be large compared with the rate at which the input signal is progressed through the register 15.

The weighting coefficients in the memory can simply be set on the basis of the response of the system to the passage of a single delta function and the compensation improved by empirical adjustment to give a characterisation which accurately nulls any input signal.

FIG. 11 shows how the weighting coefficients can be stored in a recirculating register 16 to update the characterisation. As shown in FIG. 11 the test response introduced (at regular or irregular intervals) via a summer 17 is (say) 10% of the input so that only gradual modification of the weighting coefficients will occur to allow for extraneous noise.

Since the extraneous noise is not correlated to the test signal or the signal movement in the delay unit, it will add or substract with equal probability at each point in the delay register, averaging to zero.

Figure 12:
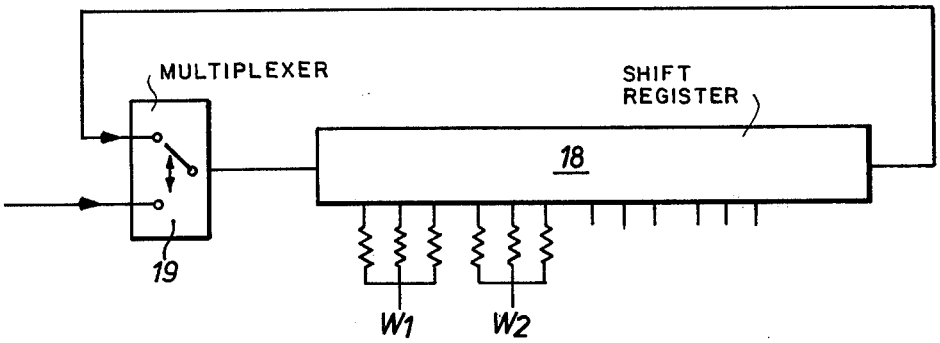

The register 16 could be implemented as a shift register 18, and the weighted summer 17 as a time multiplexer 19, as indicated in FIG. 12, the multiplexer 19 connects to the test response input only (say) 10% of the time.

A further embodiment of a system in accordance with this invention consists of a single delay unit having discrete stages, each stage containing the digital equivalent of the relevant sample of the input signal. The information in the memory is also in digital form and the multiplier is a digital multiplier.

The delay unit or the memory (or both) can alternatively contain analogue rather than digital information. For example the delay unit can consist of a charge coupled shift register, or alternatively a series of "sample and hold " circuits.

An example of an analogue version of the memory for the weighting coefficient is simply a series of potentiometers, connected to power supplies, each potentiometer being set according to the required weighting coefficients.

A specific implementation of the invention has a number of "sample and hold" circuits cascaded to produce an analogue shift register, such that the analogue information stored in any one element is passed to the next on receipt of a "sample" signal. Sample signals are provided in sequence to each element, starting at the end of the register containing the oldest signal. In this way information is only overwritten after it has been sampled.

Each analogue value in turn can then be routed to a multiplying digital-to-analogue converter by means of an analogue multiplexer, whose binary address inputs are connected to a counter. This counter is common to the waveform generator, thus ensuring that each element being sampled is always multiplied by the corresponding element stored in random access memory. The waveform for the convolving, stored in the random access memory, can be modified in a simple or complex manner by a processor or other logic system in a way dependent upon a comparison of the levels of the residuals or uncancelled signals, before and after the waveform has been modified. This residual signal can be monitored by a downstream microphone and a sound level detector.

Figure 13:
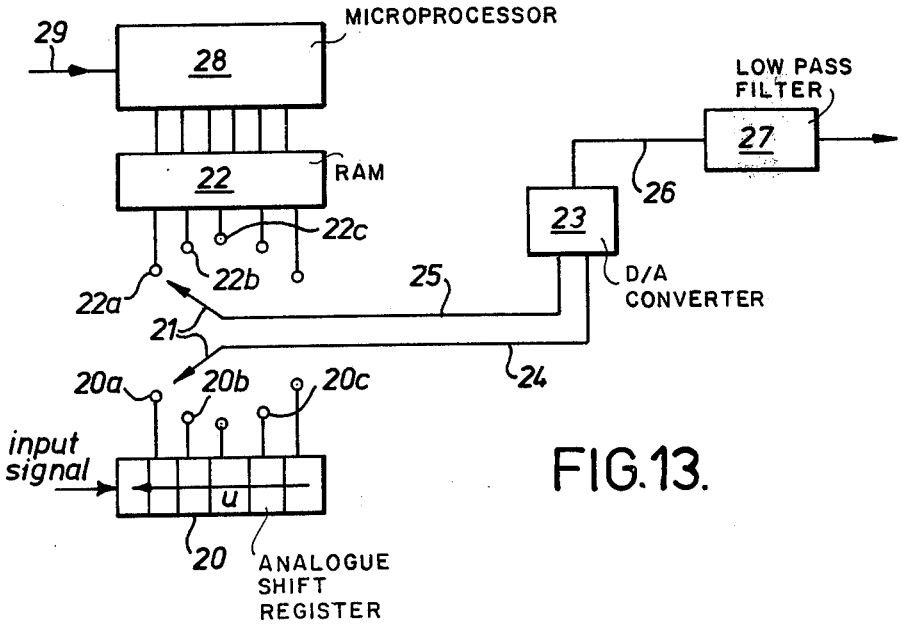

FIG. 13 shows a preferred arrangement of the system of FIG. 10 which operates as follows:

An analogue input signal representing the primary wave to be nulled is fed to an analogue shift register 20 which comprises 32 sample-and-hold circuits. The outputs 20*a*, 20*b*, 20*c* etc are scanned by an analogue multiplexer 21 in synchronism with the scanning of the outputs 22*a*, 22*b*, 22*c* etc of a 32-stage random access memory (RAM) 22 which stores the convolution waveform in digital form. The waveform stored in the RAM 22 can have been derived by subjecting the system to delta functions in the manner described.

The multiplexer 21 connects outputs 20*a*, 22*a* then 20*b*, 22*b* etc in pairs sequentially to a multiplying digital-/analogue converter 23, having an analogue first input 24, a digital second input 25 and an analogue output 26. In the particular case discussed the sweep of all 32 contacts of the register 20 and of the RAM 22 is completed in one millisecond and prior to commencing the next sweep from contacts 20*a*, 22*a*, the register 20 is up-dated to reflect changes in the input signal, up-dating occurring in the direction of the arrow U.

The convolution requires the integral of the waveform over the full sweep to be taken and a low pass filter 27 acts as an integrator (the cut-off frequency of filter 27 being a function of the reciprocal of the sweep time of the multiplexer).

To further improve the performance of the system a processor 28 is provided which receives any residual signal on a line 29 (eg. from the downstream microphone 7). The processor 28 is programmed to modify the contents of the RAM 22 on the basis of the residual signal. The algorithm employed for the modification of the RAM by the processor is open to wide variation depending on circumstances. Thus, for example, the appearance of a residual signal on the line 29 can occasion an adaptive adjustment of the information at each address in the RAM in turn, at groups of addresses in turn or at all addresses together. Any change made in the waveform stored in the RAM can be assessed to see if it has improved the situation (e.g. by noting how the signal on the line 29 changes) improving changes in the stored information being retained while non-improving changes are cancelled. The logic employed for this adaptive strategy can be sophisticated to the point where the algorithm is changed as the system "learns" which are the most sensitive regions of the waveform stored in the RAM and concentrates on modifying these while a signal remains on the line 29.

The apparatus and method of the invention are applicable to a wide range of different industrial applications included among which can be mentioned the attenuation of noise in ducted ventilation systems, exhaust systems and in the inlet and outlet chambers of gas turbines.

In the case of an exhaust system, for example, the cancellation transducer(s) can be located outside the exhaust pipe (eg. as a ring clustered closely around the pipe) with a further residual signal transducer placed at some appropriate position away from the exhaust pipe. Because of the mismatch between the exhaust outlet and its surroundings, the unwanted upstream signal will be greatly attenuated and in this application the cancelling transducer(s) can be of relatively low power.

What is claimed is:

1. Apparatus for achieving attenuation of a primary wave in a system by a specially generated secondary wave comprising first transducer means for deriving a first electrical signal representing, in a time-related manner, the primary wave to be attenuated, second tranducer means for generating the secondary wave from a second electrical signal, storage means in which a programme of time-related operational steps characterizing the system is contained and means for convolving the first electrical signal with the programme to produce the second electrical signal.

2. Apparatus as claimed in claim 1, in which a third transducer is located downstream of the first and second transducers in the direction of propagation of the primary wave, means being provided to modify the second electrical signal on the basis of the output of the third transducer in the sense to improve the degree of attenuation of the primary wave achieved by the apparatus.

3. Apparatus as claimed in claim 2, in which the means operated on by the output of the third transducer adjusts the programme of operational steps involved in the convolving.

4. Apparatus as claimed in claim 1, in which a second storage means is provided for the first electrical signal and at least one multiplier is provided to operate between the two storage means.

5. A method of attenuating sound in a defined space comprising deriving with a first transducer a first electrical signal representing, in a time-related manner, a primary sound wave which is to be attenuated and which is entering said space, and using said first electrical signal to derive a second electrical signal, said second electrical signal being used in a second transducer to generate a secondary wave in said space which will at least partially nullify the primary wave in said space, characterized in that the second electrical signal is derived from the first by convolving the first electrical signal with a programme of time-related operational steps which characterizes the first and second transducer and the acoustic path therebetween.

6. A method as claimed in claim 5, in which the programme of time-related operational steps is derived by determining the response of the transducers in the space to characterising impulses.

7. A method as claimed in claim 6, in which the programme is pre-set.

8. A method as claimed in claim 6, in which the programme is adjusted during attenuation to improve the degree of attenuation of the primary wave.

9. A method as claimed in claim 8, in which the programme is adjusted automatically on the basis of the output from a third transducer in the defined space.

10. A method as claimed in claim 6 in which any effect of the secondary wave on the output of a first transducer used to derive the first electrical signal is avoided by subtracting from the output of the first transducer a signal representative of that part of the signal generated by the first transducer which is due to feedback from the second transducer.

* * * * *